United States Patent [19]

Lehmann

[11] Patent Number: 4,579,330

[45] Date of Patent: Apr. 1, 1986

[54] PNEUMATIC SHEET FEEDER

[75] Inventor: Werner Lehmann, Gutach, Fed. Rep. of Germany

[73] Assignee: Mathias Bäuerle GmbH, Fed. Rep. of Germany

[21] Appl. No.: 717,705

[22] Filed: Mar. 29, 1985

[30] Foreign Application Priority Data

Dec. 24, 1984 [DE] Fed. Rep. of Germany ..... 3447331

[51] Int. Cl.[4] ..... B65H 3/10

[52] U.S. Cl. ..... 271/11; 271/108; 271/98; 271/110; 271/258

[58] Field of Search ..... 271/11, 94, 96, 97, 271/98, 99, 108, 110, 111, 165, 166, 259, 258, 265; 414/116

[56] References Cited

U.S. PATENT DOCUMENTS

| | | | |
|---|---|---|---|
| 1,888,194 | 11/1932 | Broadmeyer | 271/98 |
| 3,385,593 | 5/1968 | Snellman | 271/98 |
| 3,947,016 | 3/1976 | Horung et al. | 271/265 |
| 4,299,381 | 11/1981 | Smith | 271/98 |

*Primary Examiner*—Bruce H. Stoner, Jr.
*Assistant Examiner*—James E. Barlow
*Attorney, Agent, or Firm*—McGlew and Tuttle

[57] ABSTRACT

A pneumatic sheet feeder for removing individual sheets from a stack comprises a table having a surface for supporting a stack of sheets. A pair of parallel guide rails are provided on the table and with facing surfaces so that the stack is confined between the guide rails for movement in a feed direction across the table. Blast nozzles are provided in the guide rails for blowing air against the stack to form an air cushion between lower sheets of the stack. A suction cylinder is rotatably mounted to the table and includes a suction chamber therein for receiving a vacuum. Radial openings in the suction chamber cause a suction induced adhesion of a leading edge of a lowermost feed in the stack so that with rotation of the cylinder, the lowermost feed is fed in the feed direction away from the rest of the stack. A single blower is provided with a pair of two-way solenoid valves and a switching circuit is provided for alternately activating the valves. The valves are connected to a single blower having a discharge line and a suction line so that by simply switching the valves over between two positions, the blast nozzles are provided with compressed air and the suction chamber is provided with a vacuum.

6 Claims, 6 Drawing Figures

PNEUMATIC SHEET FEEDER

FIELD AND BACKGROUND OF THE INVENTION

The present invention relates in general to devices for the individual feeding of sheets from a stack, and in particular to a new and useful pneumatic sheet feeder which includes a single blower for establishing an air cushion between sheets to be fed, and for establishing a suction in a suction cylinder for pulling off individual sheets from the stack.

Sheet feeders of this kind may be employed for removing individual sheets consecutively from a stack and delivering them in predetermined intervals to packaging machines, printing presses, labeling and marking machines, etec. By means of blast nozzles provided in guide rails, air is blown against the lowermost sheets of a stack, whereby at least thin air cushions are formed between the individual sheets, thus facilitating the removal of a single sheet at a time from the bottom of the stack. By means of a suction cylinder, the leading edge portion of every lowermost sheet is engaged by suction, and advanced below the limiting edge of a stop plate which is fixed, yet adjustable to different sheet thicknesses, to conveying means downstream of the stack, for further transportation.

In prior art feeders of this kind, separate devices, namely a blower and an exhauster, are provided for supplying the blast nozzles with compressed air, and producing a vacuum in the vacuum chamber of the suction cylinder, with the blower being in permanent connection with the blast nozzles, while the exhauster is connected to the vacuum chamber only periodically, in intervals timed by means of a solenoid valve in accordance with the operating cycle of the machine.

These prior art apparatuses require not only two different devices for blowing and exhausting, but also bypass lines which considerably increase manufacturing costs.

SUMMARY OF THE INVENTION

The present invention is directed to a simplification of a feeder of the above mentioned kind which produces both compressed air for the blast nozzles and a vacuum in the suction cylinder by means of a single device.

Accordingly an object of the present invention is to provide a pneumatic sheet feeder for removing individual sheets from a stack comprising a table having a surface for receiving a stack of sheets, a pair of spaced apart parallel guide rails on the table having surfaces facing each other for receiving the stack of sheets therebetween, there being a plurality of blast nozzles in the facing surfaces for establishing an air cushion between lowermost sheets in the stack, and a suction cylinder rotatably mounted to the table and having a surface for receiving a leading edge of a sheet in the stack. A suction chamber is provided in the suction cylinder and the suction cylinder is provided with radial openings so that when a vacuum is applied to the suction chamber, and the suction cylinder is rotated, a sheet is fed from the stack in a feed direction over the table surface. Single blower is provided and is connected through a first two-way solenoid valve to the vacuum chamber, and through a second two-way solenoid valve to the blast nozzles. The valves are operated in alternating fashion so that the nozzles are provided with air to establish a cushion between sheets and the stack and, thereafter, a vacuum is applied to the suction chamber for drawing a sheet from the bottom of the stack. A sensor switch is connected to the two two-way valves and is positioned downstream of the suction cylinder in the feed direction. The sensor switch activates the valves so that air is provided to the blast nozzles when the leading edge of a sheet passes the sensor switch. When the trailing edge of the sheet passes the sensor switch, the valves are reactivated to apply a vacuum to the suction chamber and discontinue the supply of air to the blast nozzles.

This design has the particular advantage of not only being equipped with a single device for blasting and exhausting, but also, due to a substantially improved efficiency, of operating almost without losses and thus having a higher performance, or permitting reduced constructional dimensions as compared to hitherto usual sizes.

A further object of the invention is to provide such a sheet feeder wherein a time delay circuit is connected between the sensor switch and the valves for establishing a time delay between the time that a trailing edge of the sheet passes the sensing switch, and which the valves are switched over.

Due to this additional control, a delay of 10 to 150 milliseconds can be adjusted, which means that the sheets are invidually fed with these time intervals therebetween. The feeder can therefore be used for a great variety of purposes, or combined with different paper treating machines.

A further object of the present invention is to provide a method of removing individual sheets from a stack which utilizes the inventive concepts.

A still further object of the invention is to provide a pneumatic sheet feeder which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the following, one embodiment of the invention is explained in more detail with reference to the drawings in which.

DESCRIPTION OF THE PREFERRED EMBODIMENT

Figure 1:
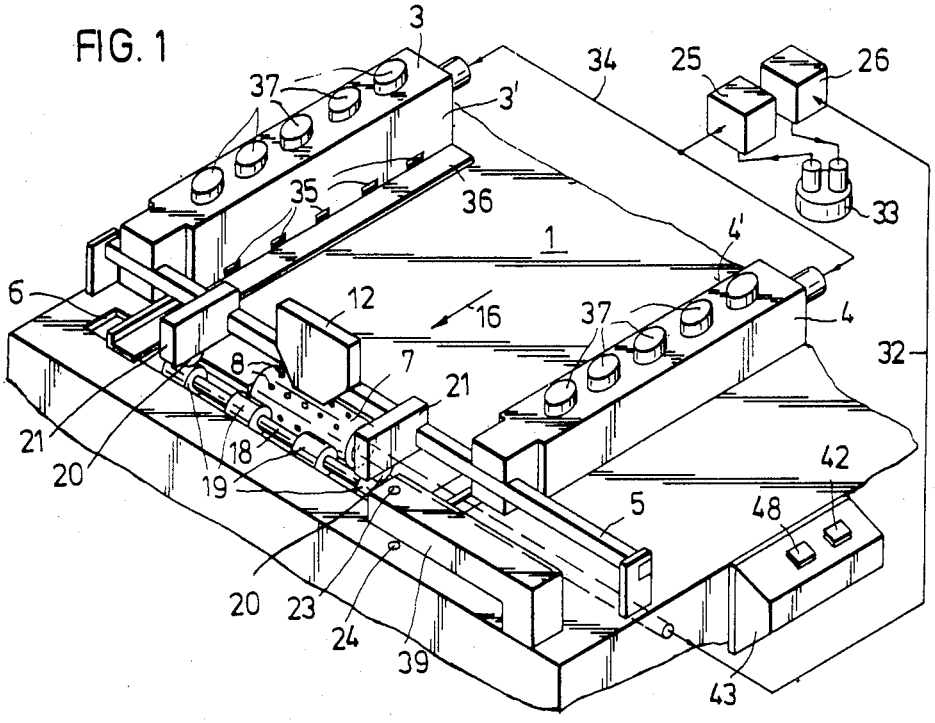
FIG. 1 is a perspective view of the upper part of the pneumatic sheet feeder.
Figure 2:
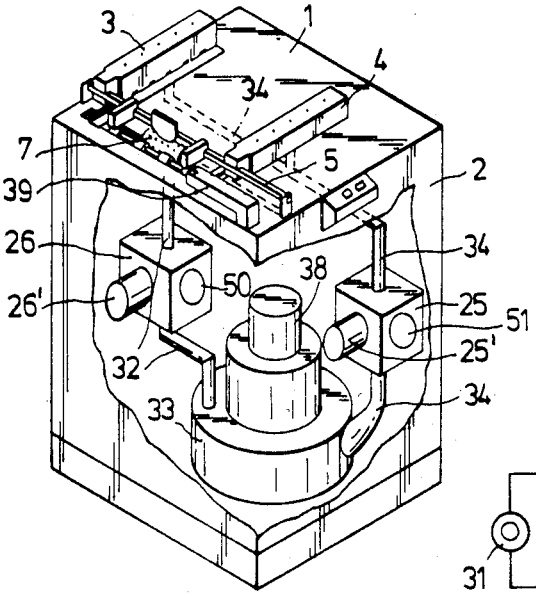
FIG. 2 is a perspective view, on a reduced scale, of the entire feeder according to FIG. 1, with a box-like base frame.

As best shown in FIGS. 1 and 2, the top surface 1 of a block base frame 2 forms the area of a feed table on which two sheet guide rails 3, 4 extend parallel to each other. They are displaceable transversely relative to each other and are detachably fixed to a cross rail 5 by means of clamping mechanisms (not shown). In a recess 6 of the top surface 1, a suction cylinder 7 is mounted for rotation below the cross rail, and extends parallel thereto. In a manner known per se, suction cylinder 7 is designed as a tube having a plurality of radial suction opening 8 which are arranged in rows. Within suction cylinder 7, a vacuum chamber 9 is provided (FIGS. 3 and 4) having the shape of a cylinder sector embracing a sectorial angle $\alpha$ of about 65° to 70°, thus covering about three rows of suction openings 8 of the cylinder. Suction cylinder 7 is so disposed that the horizontal top surface 1 is at least substantially tangential to cylinder 7 at one location of its outer cylindrical surface 10. As known per se in such constructions, vacuum chamber 9 is pivotable about the central axis of the suction cylinder, so that the suction sector of the cylinder can always be selected to best comply with the quality of the treated paper. Cylinder 7 then rotates around chamber 9 to pull a sheet in a feed direction. Above suction cylinder 7, a vertically extending stop plate 12 is mounted whose lower limiting edge 13 is spaced from the circumference 10 of the suction cylinder by a distance corresponding to the individual thickness of the sheets. Stop plate 12 is mounted in a position such that it's vertical stop surface 14 is offset in the downstream direction relative to a central vertical plane 15 of suction cylinder 7 by a smaller distance a of about 2 to 3 mm. Farther in the feed direction indicated by arrow 16 in FIG. 1 conveying means 17 are provided in front of suction cylinder 7, comprising a plurality of rollers 19 secured to a shaft 18, and two back-up rollers 20 which are mounted for rotation in bearing boxes 21. Bearing boxes 21 are mounted on cross rail 5 symmetrically of suction cylinder 7. The length of suction cylinder 7 is about 60 mm, which is substantially less than the width of a stnadard paper size A4, for example.

Downstream of conveying means 17, an electronic sensor switch 22 in the form of a light barrier is provided, comprising a light source 23 and a photoelement 24. Switch 22 is intended for controlling two two-way solenoid valves 25,26 as will be explained hereinafter. Conveying means 17 are so disposed that the nips between driven rollers 19 and back-up rollers 20 extend at the level of the horizontal tangential plane 27 of suction cylinder 7, which is also the plane of top surface 1. Between suction cylinder 7 and conveying means 17, a sloping guide sheet 28 is provided having its lower edge 29, which is close to suction cylinder 7, about at the level of edge 30 of the vacuum chamber 9, and being intended for guiding the leading edge of the individual sheets to the rollers 19, 20. Rollers 19 and suction cylinder 7 are driven by a common motor 31 (FIG. 5) at an at least approximately identical circumferential speed. It is advantageous, however, to drive rollers 19 at a circumferential speed exceeding by about 10% that of the suction cylinder 7.

While vacuum chamber 9 of suction cylinder 7 is connected to the suction side of a closed blower housing 35 through an air conduit 32 in which a two-way valve 26 is provided, an air conduit 34, through a two-way valve 25, leads to rails 3,4 which are equipped with blast nozzles 35 which have their orifices just above thin strips 36 extending along rails 3, 4 on top surface 1. Nozzles 35 are arranged on the insides 3',4' facing each other of rails 3,4 and they are provided with valves (not shown) which can be closed completely or partly through manually actuated knobs 37. The blower accommodated in blower housing 33 is driven by an electric motor 58. The compact assembly of the blower as well as the two valves 25, 26 are supported in the base frame 2. The light source 23 of switch 22 is accommodated in an angle member 39, while photoelement 24 is supported plumb below, underneath top surface 1. The thin strips 36 slightly lift the edges of the sheets reposing thereon so that the entrance of air from the blast nozzles between the sheets to form air cushions is facilitated.

Figure 5:
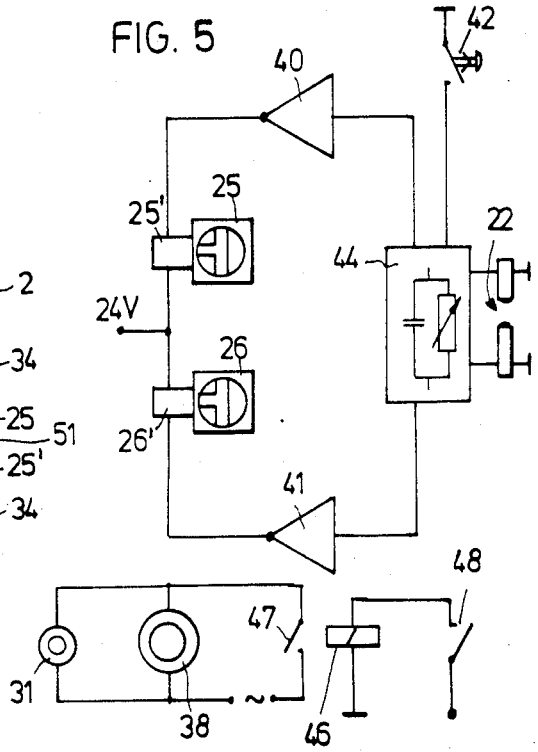
FIG. 5 is a basic schematic diagram of the control circuit.

To switch electric motors 31 and 38 on and off, and to operate the two two-way valves 25,26, a control device is provided, as diagrammatically shown in FIG. 5. The control device comprises two inverting amplifiers 40, 41 having their outputs applied to solenoids 25', 26' of the two two-way valves 25,26, and being themselves controlled by an electronic timing circuit 44 which can be set to delay periods of 0 to 150 milliseconds and to which sensor switch 22 is connected. Further connected to timing circuit 44 is a manually operated starting switch 42 for starting the paper feed. Electric motors 31 and 38 are started through a relay 46 and the closing contact 47 thereof, with the relay 46 being switchable through a manually actuated closing switch 48. The two switches 42, 48 are mounted on a side console 43 of base frame 2.

Figure 3:
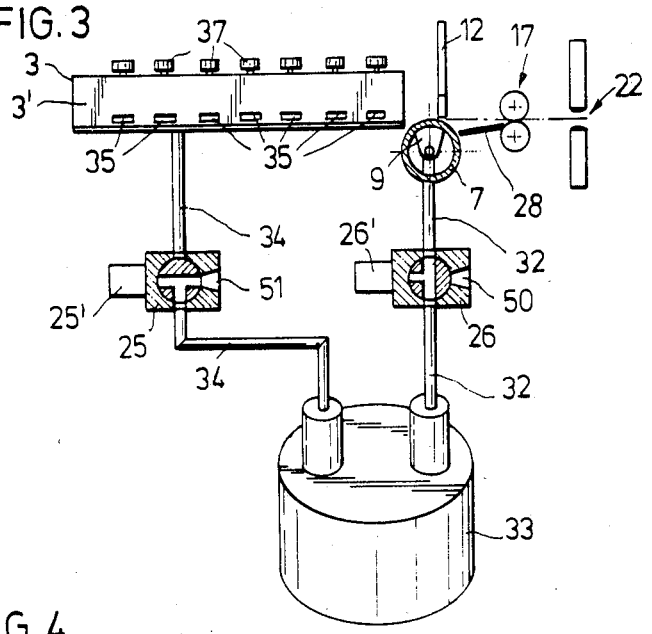
FIG. 3 is a diagrammatical illustration of the function of the feeder.
Figure 4:
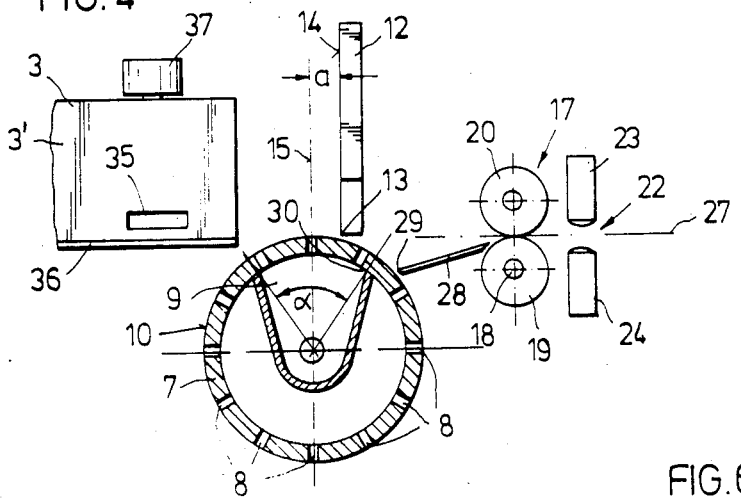
FIG. 4 illustrates the singling out operation on a larger scale.
Figure 6:
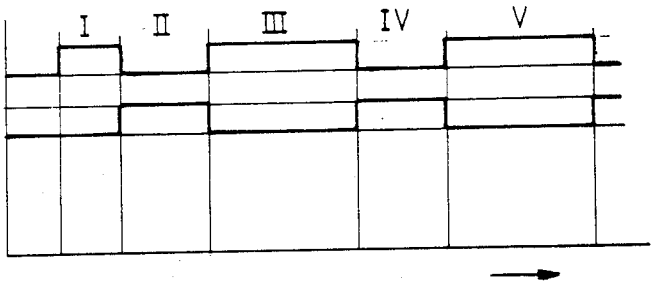
FIG. 6 is a time diagram of switching intervals of two valves used in the invention.

The feeder operates as follows:

It is first assumed that a paper stack has been placed on top surface 1 between the two guide rails 3, 4, in a manner such that the leading edges of the sheets forming the stack apply against the stop surface 14 of stop plate 12 and that spacing of the two guide rails 3,4 from each other is adjusted to a distance corresponding, with a slight tolerance, to the width of the sheets. First, the two motors 31 and 38 are started, thus the blower in blower housing 33, and suction cylinder 7 as well as conveying rollers 19 are set in motion. A provided initial functional operation of the control makes sure that two-way valve 25 assumes an open position, such as shown in FIG. 3 for the other valve 26. This means that the open blast nozzles 35 are supplied with compressed air, so that thin air cushions are formed between the lowermost sheets of the stack, through which the separation of the sheets from one another is faciliated and ensured. This switching phase corresponds to time interval I shown in FIG. 6. During this interval, the connection between vacuum chamber 9 of suction cylinder 7 and blower housing 33 is shut off, since valve 26 is in a close position (in which valve 25 is shown in FIG. 3). This means that the air delivered from the pressure side of the blower through open valve 25 to nozzles 35 is taken in through suction port 50 of valve 26.

By shortly actuating starting switching switch 42, the feed of the paper is started. In consequence, the two valves 25 and 26 are switched in such a way that they now occupy their positions shown in FIG. 3, in which vacuum chamber 9 is connected by its suction side to blower housing 33, while the connection between blower housing 33 and the nozzles 35 is shut off, and the air delivered by blower is discharged through port 51 of valve 25. Due to the vacuum produced in vacuum chamber 9, the lowermost sheet is engaged by suction cylinder 7 and advanced over guide sheet 28 to conveying means 17 for further transportation. Since the air cushions between the lowermost sheets of the stack do not disappear instantly upon shutting off the air supply, and remain in place for a short time, the two valves 25,26 may be switched over simultaneously. As soon as the leading edge of an individual sheet reaches sensor switch 22, the two valves 25,26 are switched over again, in a way such that now nozzles 35 are again supplied with air, while the connection between vacuum chamber 9 and blower housing 33 is shut off. In this way, air cushions between the lowermost sheets of the stack are formed again, until the next sheet is singled out. As soon as the trailing edge of the just conveyed sheet passes by sensor switch 22, a corresponding signal is delivered to the electric time delay circuit 44 by which, depending on the delay time set, the next switching of the two valves 25,26 is effected instantly or with the set delay, whereupon the next lowermost sheet is engaged by suction cylinder 7 and transported to rollers 19, 20. In this way, the stiching phases follow each other in the manner shown in FIG. 6 by the time intervals II, III, IV, V, etc. until the last sheet is fed and the machine is stopped.

As usual in such feeders, another stack may, of course, be put in place on top of the preceding one, before the first stack is worked up.

While a specific embodiment of the invention has been shown and described in detail to illustrate the application of the principles of the invention, it will be understood that the invention may be embodied otherwise without departing from such principles.

What is claimed is:

1. A pneumatic sheet feeder for removing individual sheets from a stack, comprising:

a table having a surface for a stack of sheets;

a pair of spaced apart parallel guide rails on said table surface having facing surfaces for receiving a stack of sheets therebetween, each facing surface including at least one blast nozzle for discharging a blast of air toward the stack for establishing an inner cushion at least between at least two sheets of the stack;

a suction cylinder rotatably mounted to the table and having an outer surface disposed so as to receive a leading edge of a sheet in the stack, in a feed direction across said table surface, said suction cylinder including openings therein;

suction chamber means disposed in said suction cylinder for confining a partial vacuum and applying said partial vacuum to at least some of the openings of said suction cylinder for drawing a sheet toward the suction cylinder outer surface, a single blower having a housing with a discharge line and and a suction line for discharging air and for drawing air respectively;

a first two-way valve connected between said suction chamber means and said suction line, said first valve having a first position for connecting said suction line to said suction chamber means for establishing a partial vacuum in said suction chamber means, and a second position for connecting said suction line to atmosphere;

a second valve connected between said discharge line and said guide rails, said second valve having a first position for connecting said discharge line to said blast nozzles to supply compressed air to said blast nozzles to establish the air cushion, and a second position for connecting said discharge line to atmosphere;

conveyor means disposed downstream of said suction cylinder in said feed direction for receiving a sheet removed from the stack and transporting it further in said feed direction;

a sensor switch connected to said first and second valves and disposed downstream of said suction cylinder, said sensor switch being activated by the passage of a leading edge of a sheet and by the passage of a trailing edge of a sheet moving in the feed direction, said sensor switch being connected to said first and second valves for simultaneously placing said first valve in its second position and said second valve in its first position when a leading edge of a sheet is sensed, and for switching said first valve to its first position and said second valve into its second position with the passage of a trailing edge of a sheet.

2. A feeder according to claim 1, wherein said valves comprise two-way solenoid valves, said blast nozzles of said guide rails positioned to establish an air cushion between lowermost sheets of a stack, said sensor switch disposed downstream of said conveyor means.

3. A feeder according to claim 2, including a time delay circuit connected between said sensor switch and said first and second valves for establishing a preselected time delay between the passage of a trailing edge of a sheet and the switching of said first and second valves.

4. A feeder according to claim 1, wherein said conveyor means comprise a plurality of rollers defining nips therebetween for receiving a sheet, and motor means connected to said rollers for rotating said rollers to convey a sheet in said feed direction.

5. A feeder according to claim 4, including second motor means connected to said suction cylinder for rotating said suction cylinder, and a common actuation switch connected to said first mentioned and second motor means for actuating them simultaneously.

6. A feeder according to claim 5, including delay means connected between said sensor switch and said valves for delaying the actuation of said valves with the passage of a trailing edge of a sheet.

* * * * *